US006972082B2

(12) United States Patent
Kotsias

(10) Patent No.: US 6,972,082 B2
(45) Date of Patent: Dec. 6, 2005

(54) METHOD FOR THE SELECTIVELY ELECTROPLATING A STRIP-SHAPED, METAL SUPPORT MATERIAL

(75) Inventor: Michail Kotsias, Oetischeim (DE)

(73) Assignee: IMO Ingo Müller e.K., Königsbach-Stein (DE)

( * ) Notice: Subject to any disclaimer, the term of this patent is extended or adjusted under 35 U.S.C. 154(b) by 114 days.

(21) Appl. No.: 10/484,205

(22) PCT Filed: Jun. 20, 2002

(86) PCT No.: PCT/EP02/06824

§ 371 (c)(1),
(2), (4) Date: Jan. 20, 2004

(87) PCT Pub. No.: WO03/012175

PCT Pub. Date: Feb. 13, 2003

(65) Prior Publication Data

US 2004/0206629 A1 Oct. 21, 2004

(30) Foreign Application Priority Data

Jul. 20, 2001 (DE) ..... 101 35 349

(51) Int. Cl.[7] ..... C25D 5/02
(52) U.S. Cl. ..... 205/129; 204/478; 204/486; 204/488; 204/512; 205/135; 205/183; 205/917
(58) Field of Search ..... 205/129, 135, 205/183, 917; 204/478, 486, 488, 512

(56) References Cited

U.S. PATENT DOCUMENTS 5,035,918 A 7/1991 Vyas
6,663,759 B1 * 12/2003 Copping et al. ..... 205/118

FOREIGN PATENT DOCUMENTS

DE 199 34 584 1/2001
WO WO 00/52231 9/2000

* cited by examiner

*Primary Examiner*—Roy King
*Assistant Examiner*—William T. Leader
(74) *Attorney, Agent, or Firm*—Browdy and Neimark, PLLC

(57) ABSTRACT

A method for the continuous selective electroplating of a metallic substrate material (10) and more particularly of a substrate material band having prestamped contact elements, comprises the following steps:

a) the substrate material (10) is coated in an electrophoretic coating means (14) with an electrophoretic coating composition selective with at least one composition strip,
b) the at least one composition strip is removed at those parts by means of a laser (40), which are to be electroplated,
c) in an electroplating process a metal layer is applied to the areas (42) deprived of composition in at least one composition strip using selective electroplating and
d) the at least one composition strip is then removed.

10 Claims, 3 Drawing Sheets

METHOD FOR THE SELECTIVELY ELECTROPLATING A STRIP-SHAPED, METAL SUPPORT MATERIAL

The invention relates to a continuous method for the selective electroplating of a metallic substrate material band, and more particularly for the electroplating of a substrate material band having prestamped contact elements.

In the case of such a method as disclosed in the German patent publication 19,934,584 A1 the substrate material is firstly completely coated with coating composition by being either sprayed with it or dipped therein. Then using a laser those parts are freed of coating composition, on which the contact material is to be applied by electroplating.

In the case of the known method, both with spraying with the coating composition and also by dipping therein, only producing a coating composition layer with an uneven thickness there is the disadvantage. Such a problem becomes more acute in the case of three-dimensional substrate material, since here extremely thick deposits of the coating composition collect more particularly at the corners and edges. Furthermore, an unbroken coating composition layer, which is absolutely necessary for the method, can only be produced, if it is relatively thick. In the case of laser removal of material at the parts to be electroplated this will mean either a time-consuming operation or it will be necessary to utilize high power lasers. Since the coating composition layer must be completely removed in the areas to be electroplated, it is necessary to so set the laser beam that the coating composition layer is also removed in areas with maximum coating composition thickness. This in turn means that in areas with a small coating composition thickness the substrate material will be damaged by the laser beam. A further disadvantage of the known method is that even if only very small areas have to be electroplated, very large quantities of coating composition will be required for the complete coating of the substrate material with a coating composition layer. The relatively large thickness of the coating composition layer necessary for producing an unbroken coating composition layer and more particularly the substantial accumulations of coating composition in the case of three-dimensional substrate materials represent an added difficulty here. In this case it is necessary to take into account that the coating compositions required for such a method are relatively expensive.

One object of the present invention is to so further develop the known method that more rapid transit of the band-like substrate material along the electroplating line is possible and with a substantially lower coating composition requirement.

This object in the to be attained by the invention using the method steps as defined in claim 1.

The method in accordance with the invention leads to the advantage that as regards the electrophoretic coating even with substantially smaller coating composition thicknesses an unbroken coating composition layer may be obtained, such coating composition having an extremely constant coating thickness. Owing to this during removal of the coating composition by laser damage to the substrate material may be effectively prevented. Moreover, the extremely thin coating composition layer may be removed more rapidly and using a lower power, something leading to a higher speed of motion of the substrate material through the equipment. The deposition of the electrophoretic coating composition on the substrate material takes place extremely rapidly, something which again renders possible higher throughput rates of the substrate material. These advantages are furthermore enhanced in as far as only a selective coating composition layer is applied, as for instance a coating composition strip or a plurality of coating composition strips. These coating composition strips are exclusively applied in areas wherein a layer is to be electroplated on the substrate. In addition to savings as regards expensive coating composition there is accordingly more rapid removal of the coating composition at the end of the treatment.

The electrophoretic coating step only leads, even in the case of three-dimensional substrates to even, thin coating composition layers with the result that it is possible for a selective electroplating operation to be performed here as well. Since that the removal of coating composition using the action of a laser is able to be controlled substantially freely, in addition to electroplating in strips it is also possible for electroplating to be performed at points, i. e. in punctuate areas.

The measures defined in the dependent claim are in relation to advantageous further developments and improvements is of the method indicated in claim 1.

The substrate material band preferably runs through a cleaning and/or activating and/or swilling unit in order to achieve optimum initial conditions.

It is an advantage for a plurality of coating composition strips to be applied with the same width or with different widths on the same side or both sides of the substrate material band. The width of such strips is in this case able to be exactly set by the electrophoretic coating method so that by optimizing the required amount of coating composition may be minimized.

The thickness of the coating composition may be predetermined in accordance with the voltage applied, the composition of the coating and the speed of the substrate material, a cataphoretic or anaphoretic deposit of the coating composition more particularly taking place. With such an exactly set thickness of the coating composition it is also possible, by suitably setting the laser beam, to completely remove such coating composition layer at the required positions while nevertheless preventing damage to the substrate material.

For the electrophoretic deposition of coating compositions cathodes in a housing of the coating composition applying means are preferably shielded off from the substrate by a slot-like baffle, it being possible to adjust the slot width and the distance between the baffle and the substrate material to get the right width of coating composition strip. Using baffles with a plurality of slots it is possible to form correspondingly more coating composition strips.

After applying the coating composition the substrate material is preferably swilled and dried, more especially in an oven or using ultraviolet light. Furthermore, the substrate material is advantageously swilled following the removal of composition with the laser.

The areas where composition has been removed with the laser may now be electroplated using one or more of the following selective electroplating methods: selective dipping in an electroplating bath, masking the areas outside the at least one coating composition strip using mechanical masks, more particularly belt tools, application of the electrolyte composition by means of wheel technique, spotter technique or brush technique.

Working examples of the invention are represented in the drawings and will be explained in detail in the following description.

Figure 1:
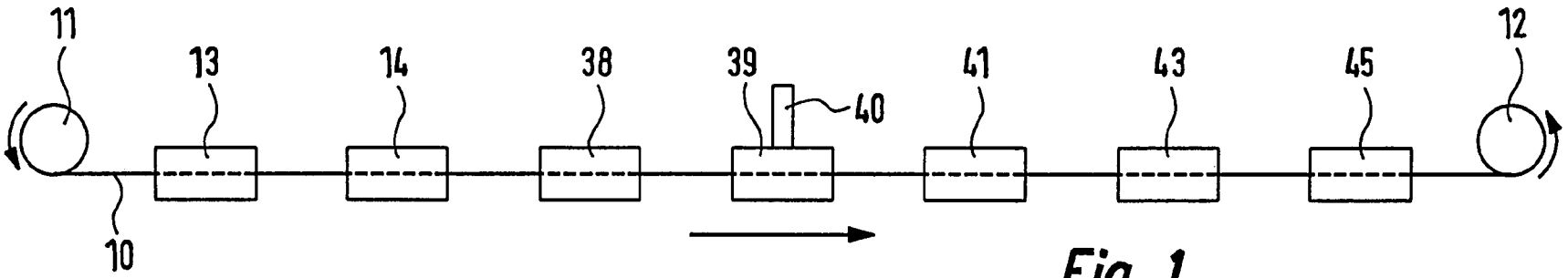
FIG. 1 is a diagrammatic representation of the individual stations of a plant for selective electroplating employed in performing the method of the invention.

The electroplating plant depicted in FIG. 1 for the selective electroplating of a substrate material band is designed in the form of a so-called reel-to-reel plant, the metallic substrate material band 10 being paid off from a first reel 11 continuously, passed through the plant and to the rear thereof then being wound up on a second reel 12 as a finished band. In this case band speeds of 20 m/min. and higher are possible.

Firstly the substrate material band 10 moves through a preparatory station 13, in which it is cleaned, activated and swilled down.

Figure 2:
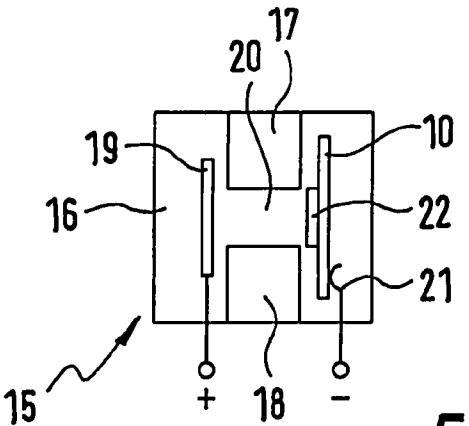
FIG. 2 is a diagrammatic representation of a coating cell for the application of a coating composition strip with a predetermined width.

Following this the substrate material band 10 is passed through a coating station 14 for coating with composition, where selective electrophoretic coating takes place. The coating station 14 may comprise one or more coating cells 15, as is diagrammatically represented in FIG. 2. Such a coating cell in principle comprises a housing, for example in the form of a capsule, which is so shielded that uncontrolled deposit of coating composition in undesired areas is not possible. For this purpose baffles 17 and 18, which like the rest of the housing parts consist of Teflon or some other non-conductive plastic, are arranged so that they cover over areas, which are not to be coated, of the substrate material band 10 as regards a plate-like anode 19. Owing to the slot 20 defined by the two baffles 17 and 18 a coating strip is formed by electrophoretic coating deposition with a corresponding width on the substrate material band 10. The anode 19 in this case consists of stainless steel but a titanium plated one is also suitable.

The coating cell 15 illustrated is designed for anaphoretic coating with an anaphoretic composition. Such a composition layer is resistant to acid media such as a nickel, gold or tin plating bath and may be removed in an alkaline environment. For anaphoretic coating the anode 19 is connected with the positive pole of an electroplating voltage, while for the supply of current to the substrate material band 19 a contacting means 21 is arranged upstream from the cell. As an alternative cataphoretic coating is possible using a cataphoretic coating composition is possible. The cataphoretic composition is resistant to alkaline media and may be removed in an acid environment. The polarity is reversed, that is to say a cathode takes the place of the anode 19.

The coating cell 15 is so designed that the coating composition strips formed and, respectively, the areas coated with the composition are not damaged after the coating operation. This protection is for example ensured by the use of guide rollers, not illustrated, which are arranged upstream from and downstream from the coating cell and so exactly position the substrate material both in the vertical and also in the horizontal direction that the area coated with the composition strip 22 does not come into contact with parts of the housing 16. The clearance between the substrate material band 10 and the baffles 17 and 18 is in this case so selected that on the one hand there is a sufficient baffle effect and on the other hand there are no points of contact.

The composition, present in a supply tank, not illustrated, is supplied by way of nozzles to the coating cell. A pump located in the supply tank is connected by way of a pipe with a coating cell, a choke valve, also not illustrated, being intermediately placed to regulate or control the rate of coating composition feed. A filter arrangement may also be present. The composition pump is so designed that by the utilization of low friction materials on all moving part, electric charges are prevented, as otherwise a deposition of the composition on moving parts, which might become electrically charged and come into contact with the composition, might take place.

In FIGS. 3 through 10 different types of substrate material band are illustrated as examples, which are provided with differently arranged composition strips.

Figure 3:
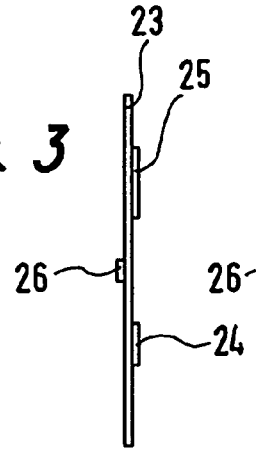
FIG. 3 is an end-on view of a substrate material band having three coating composition layers of the front and rear sides.
Figure 4:
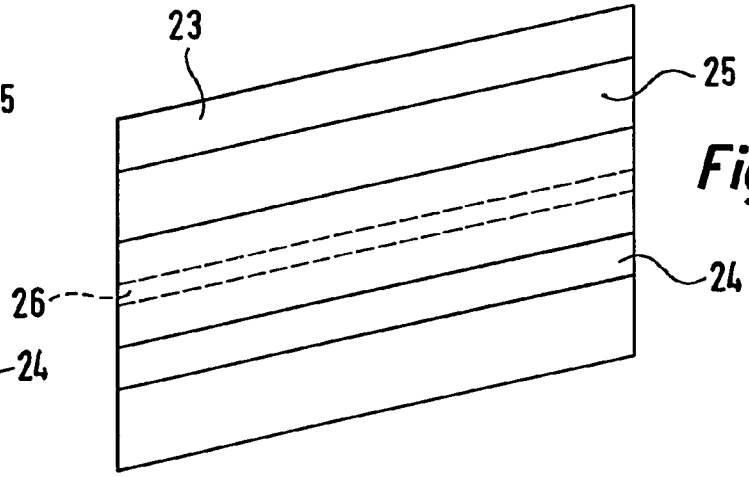
FIG. 4 is a perspective view of the substrate material band represented in FIG. 3.

In the case of the substrate material band as shown in FIGS. 3 and 4 three composition strips 24 through 26 of different width are applied to the front and rear sides. This may be performed either with tandem arranged coating cells 15 or with coating cells, which possess a plurality of slots 20 and baffles and anodes and, respectively, cathodes on either side of the substrate material band 23.

Figure 5:
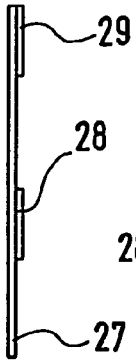
FIG. 5 is an end-on view of a stamped substrate material band bearing two coating composition layers.
Figure 6:
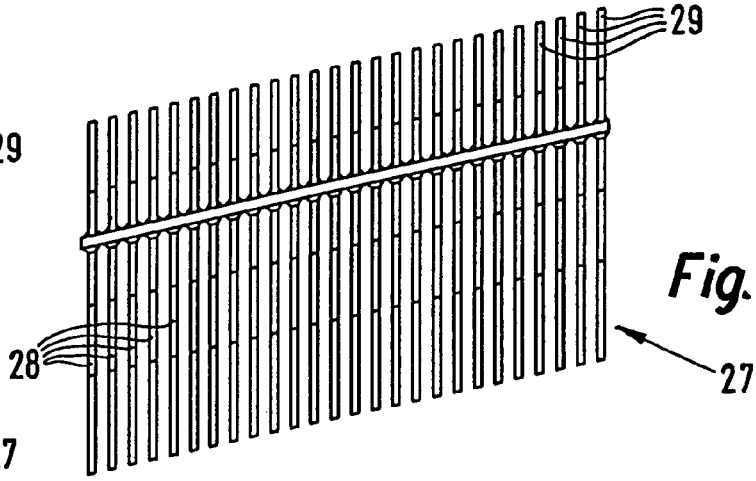
FIG. 6 is a perspective representation of the substrate material band illustrated in FIG. 4.

The substrate material band 27 represented in FIGS. 5 and 6 is so prestamped that individual electrical contacts are already formed, which after finishing may be broken or cut off. Two composition strips 28 and 29 are applied.

Figure 7:
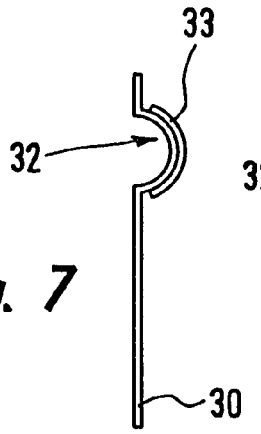
FIG. 7 is an end-on view of a three-dimensional substrate material band having one coating composition strip on the protruding part.
Figure 8:
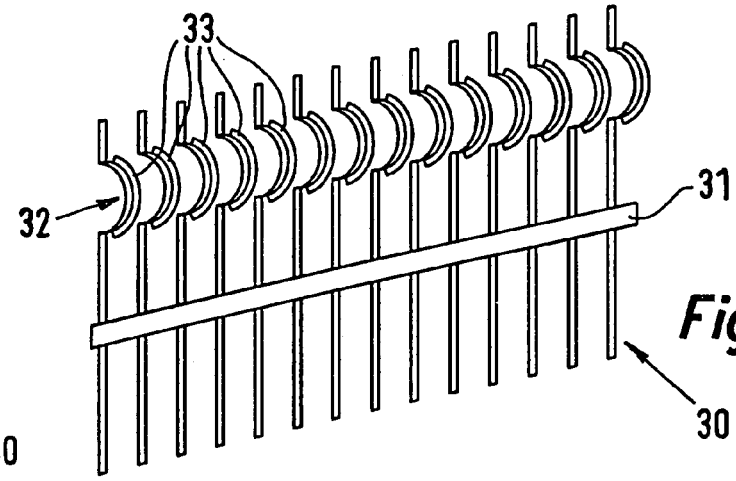
FIG. 8 is a perspective representation of the substrate material band viewed in FIG. 7.

The substrate material band 30 illustrated in FIGS. 7 and 8 is also prestamped for the formation of individual electrical contacts, such contact possessing, on one side of a holding strip 31 (which holds them together) semicircular protrusions 32 so that the substrate material band 30 is three-dimensional in structure. One composition strip 33 is applied to the outer side of the protrusions 32.

Figure 9:
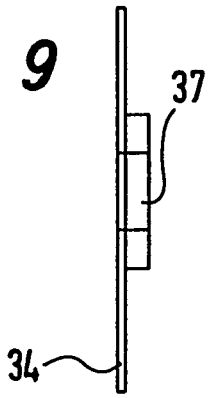
FIG. 9 is an end-on view of a further three-dimensional substrate material band having one coating composition strip.
Figure 10:
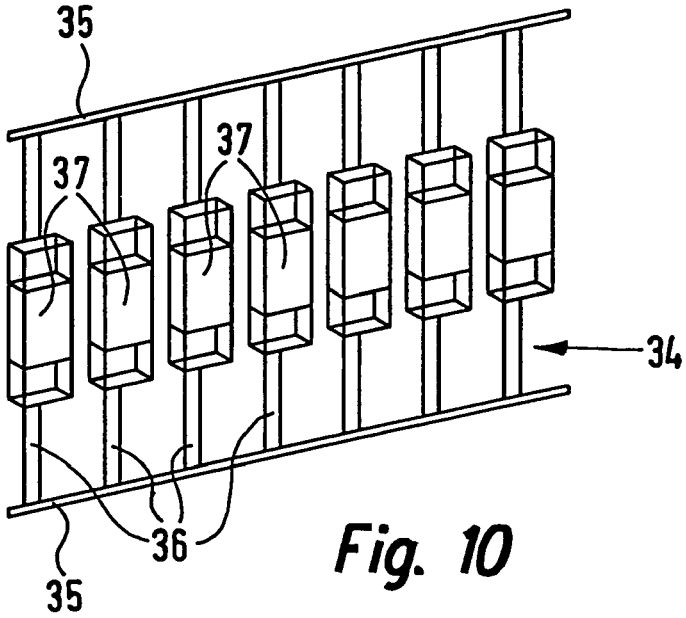
FIG. 10 is a perspective representation of the substrate material band depicted in FIG. 9.

The substrate material 34 band represented in FIGS. 9 and 10 is as well three-dimensional in shape, holding strips 35 connecting the individual contact elements 36 at their ends. These contact elements 36 are box-like in the middle area, a composition strip 37 extending over the middle part of the box-like protrusions. The selective composition strip (or a plurality thereof) is applied in the case of three-dimensional substrate material bands over the entire spatial depth as shown in FIGS. 7 through 10.

After the application of one or more composition strips the substrate material band 10 in accordance with FIG. 1 is passed through a drying station 38. Drying and accordingly partial polymerization is performed in an oven of the drying station 38, in which an even temperature distribution is maintained. Alternatively the composition strips may also be dried using ultraviolet light and be partially polymerized.

Figure 11:
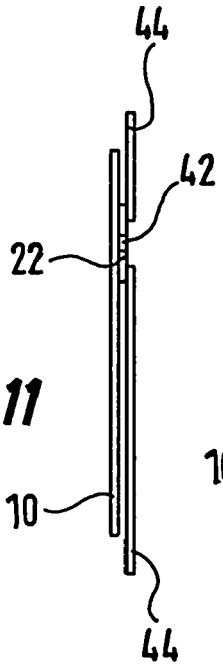
FIG. 11 shows an end-on view of a substrate material band having one coating composition strip, in which a strip area has had coating composition removed from it by laser treatment, and with a masking means for selective electroplating.
Figure 12:
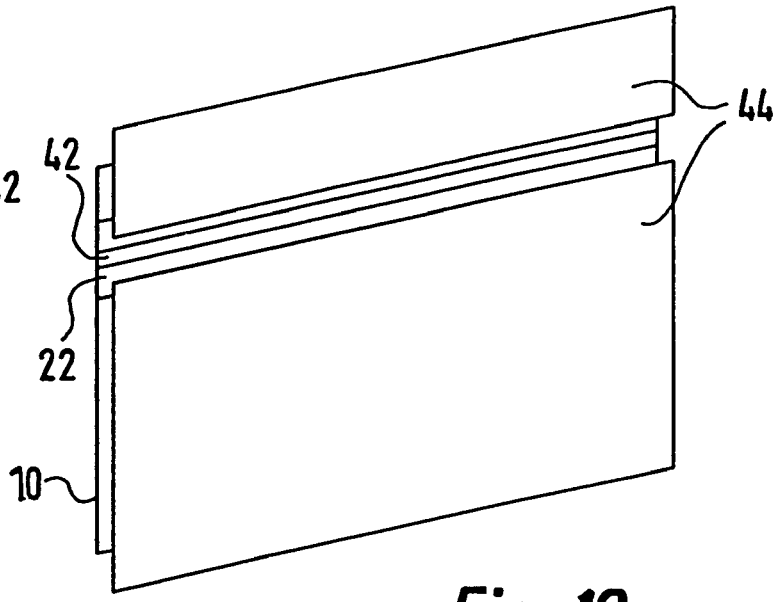
FIG. 12 is perspective representation of the substrate material band illustrated in FIG. 11.

The next step is for the substrate material band 10 to be moved through a laser station 39 for selective removal of coating. By means of the beam of a laser 40 those composition areas are cleared from the composition strip or strips, which are to be later electroplated. In this case both stripwise composition removal is possible as well as removal of composition from individual areas, this being implemented for example by causing the laser to oscillate over such areas. It is naturally also possible for a plurality of composition removal operations in strips to be performed within a composition strip using the laser. The dimensional inaccuracies or tolerances of composition removal and accordingly of the following electroplating operation are minor and for instance will amount to around 50 microns. The substrate is not damaged by the laser beam and the removal of composition is complete. This is ensured by exactly setting the laser as regards energy, wavelength, amplitude and duration of the pulses. FIGS. 11 and 12 indicate that a strip-like area 42 has been cleared from the composition strip 22 applied to the substrate material band 10 in the laser station 39.

The substrate material band 10 is now passed through an electroplating station 43, in which electroplating of the area 42 clear of composition by the laser takes place. This is implemented by a known selective electroplating method. As shown in FIG. 12 in this case the areas of the substrate material band 10 clear of the composition strip 20 are masked by two continuously circulating belts 44. The speed of the belts 44 is in this case made equal to the speed of passage of the substrate material band 10 through the apparatus so that the belts 44 keep in step accordingly. The area left free between the two belts 44 is now wetted with a cloth, a brush or the like with electroplating solution and thus electroplated. Dependent on the desired layer thickness this may be performed in a plurality of stages. If the composition strip is in a marginal area of the substrate material band 10, then it is possible for the selective electroplating also to be performed by selective dipping in an electroplating bath. As an alternative to this other mechanical masks may be utilized, one further possible known method for selective electroplating being on the basis of a spotter technique and brush technique.

As a last step the substrate material band 10 is completely cleared of coating composition in a decoating station 45 by passing it through a suitable aqueous solution. Dependent on whether a cataphoretic or anaphoretic deposition process has been employed, the aqueous solution will be acidic or alkaline.

It is naturally possible to electroplate various different materials such as gold, palladium, silver and zinc onto the substrate material band 10, which normally consists of brass, copper or a copper alloy. Various different electroplated layers may be placed on top of one another, the necessary steps for this being performed one aft the other. The substrate material band 10 may for example already bear an electroplated layer, which is applied in a conventional manner, as in the form of a selectively plated layer without a coating composition covering it.

The method in accordance with the invention may—as described—be performed on substrate material bands which in accordance with FIGS. 5 through 10 already have prestamped contacts or other elements or have a plain surface, as for example in accordance with FIGS. 3, 4, 11 and 12. In the latter case stamping operations could be performed following the electroplating operation, although this will require a larger amount of coating composition and electroplated metals.

What is claimed is:

1. A method for the selective continuous electroplating of a metallic substrate material band and more particularly of a substrate material band having prestamped contact elements, in which a) the substrate material (10, 23, 27, 30 and 34) is coated in an electrophoretic coating means (14 and 15) with an electrophoretic coating composition selective with at least one composition strip (22, 24 through 26, 28, 29, 33 and 37), b) the at least one composition strip (22, 24 through 26, 28, 39, 33 and 37) is removed at those parts (42) by means of a laser (40), which are to be electroplated, c) in an electroplating process a metal layer is applied to the area (42) deprived of composition in at least one composition strip (22, 24 through 26, 28, 29, 33 and 37) using selective electroplating and d) the at least one composition strip (22, 24 through 26, 28, 29, 33 and 37) is then removed.

2. The method as set forth in claim 1, characterized in that the substrate material band (10, 23, 27, 30 and 34) runs through a cleaning and/or activating and/or swilling stage prior to coating with the composition.

3. The method as set forth in claim 1, characterized in that a plurality of composition strip (24 through 26, 28 and 29) are applied with the same or with different widths on the same side or on both sides of the substrate material band (23 and 27).

4. The method as set forth in claim 1, characterized in that the thickness of the composition coating is set in accordance with the applied voltage, the nature of the composition and the speed of the substrate material, cataphoretic or anaphoretic composition coating being more particularly performed.

5. The method as set forth in claim 1, characterized in that electrodes (19) in a housing (16) of the composition coating means (14 and 15) are masked from the substrate material (10) by a slot-like baffle (17 and 18), the width of the composition strip being set in a manner dependent on the slot width (20) and the distance between the baffle (17 and 18) and the substrate material (10).

6. The method as set forth in claim 1, characterized in that the substrate material (10, 23, 27, 30 and 34) is swilled and, more particularly in an oven (28) or using ultraviolet light, dried after coating.

7. The method as set forth in claim 1, characterized in that the laser removal of composition leads to the formation of strips and/or individual electroplated areas (42).

8. The method as set forth in claim 1, characterized in that the substrate material (10, 23, 27, 30 and 34) is swilled following the removal of composition by laser.

9. The method as set forth in claim 1, characterized in that the areas (42) cleared of composition by the laser (40) are electroplated by one or more of the following selective electroplating methods: selective dipping in an electroplating bath, masking of the areas outside the at least one composition strip by means of mechanical masks (44), more particularly belt tools, application of the electrolyte by means of a wheel technique, a spotter technique, or a brushing technique.

10. The method as set forth in claim 1, characterized in that the at least one composition strip (22, 24 through 26, 28, 29, 33 and 37) is after electroplating completely removed in an alkaline or acid aqueous solution.

* * * * *